United States Patent [19]

Ochi

[11] 4,007,934

[45] Feb. 15, 1977

[54] APPARATUS FOR SIMULATING RECOIL IN AN IMITATION GUN

[75] Inventor: Shikanosuke Ochi, Tokyo, Japan

[73] Assignee: Kabushiki Kaisha Sega Enterprises, Tokyo, Japan

[22] Filed: Dec. 10, 1975

[21] Appl. No.: 639,610

[30] Foreign Application Priority Data

Sept. 19, 1975 Japan ..... 50-127820

[52] U.S. Cl. ..... 273/101.2; 35/25

[51] Int. Cl.[2] ..... A63F 9/02

[58] Field of Search ..... 35/25; 273/101, 101.1, 273/101.2

[56] References Cited

UNITED STATES PATENTS

| | | | |
|---|---|---|---|
| 2,398,813 | 4/1946 | Swisher | 273/101 |
| 2,520,281 | 8/1950 | Heide | 35/25 |
| 3,220,732 | 11/1965 | Pincus | 273/101.1 |

*Primary Examiner*—Anton O. Oechsle
*Assistant Examiner*—Vance Y. Hum
*Attorney, Agent, or Firm*—Wenderoth, Lind & Ponack

[57] ABSTRACT

An apparatus for simulating recoils in an imitation gun which apparatus has, as its characteristic feature, a frame, an imitation gun that is mounted on the frame in a freely movable manner, a motor that is started in response to a shot by said imitation gun, and an eccentric interposed between the imitation gun and the motor so that the imitation gun will be reciprocated by rotation of the motor.

1 Claim, 10 Drawing Figures

APPARATUS FOR SIMULATING RECOIL IN AN IMITATION GUN

The present invention relates to an apparatus for simulating recoil in an imitation gun, and more particularly, to such apparatus for an imitation gun forming part of a shooting game machine to give the user of the machine a feeling as if he has shot with a real gun.

When an automatic rifle or a machine gun is fired, recoils due to reaction of bullets are intermittently and successively exerted upon the gun barrel. However, in case of an imitation gun employed in a shooting game machine or the like, no recoil is generated at the time of firing because no bullet is really discharged, and thus recoil is not felt by the person who holds the imitation gun.

Therefore, it is one object of the present invention to provide an apparatus which can simulate recoil for a person who holds an imitation gun, when said imitation gun has been fired, as if a real gun were fired, by impulsively reciprocating said imitation gun.

According to one feature of the present invention, an apparatus for simulating recoil for an imitation gun comprises a frame, an imitation gun that is mounted on said frame in a freely movable manner, a motor that is started in response to a shot by said imitation gun, and coupling means interposed between said imitation gun and said motor so that said imitation gun is reciprocated by rotation of said motor.

Since the apparatus according to the present invention is constructed in such manner that an imitation gun is mounted on a frame in a freely movable manner and coupling means is interposed between said imitation gun and a motor adapted to be started in response to a shot of said imitation gun so that said imitation gun will be reciprocated by rotation of said motor, when the motor is started by triggering said imitation gun the rotation of said motor is transmitted to said imitation gun via said coupling means so as to cause its reciprocal motion, and thereby a feeling the same as if bullets have been discharged intermittently and successively from said imitation gun is given to a person who holds said imitation gun.

As described above, according to the present invention, it is possible to give a player or a trainee a feeling similar to that when a real automatic rifle or a real machine gun has been fired.

Figure 1:
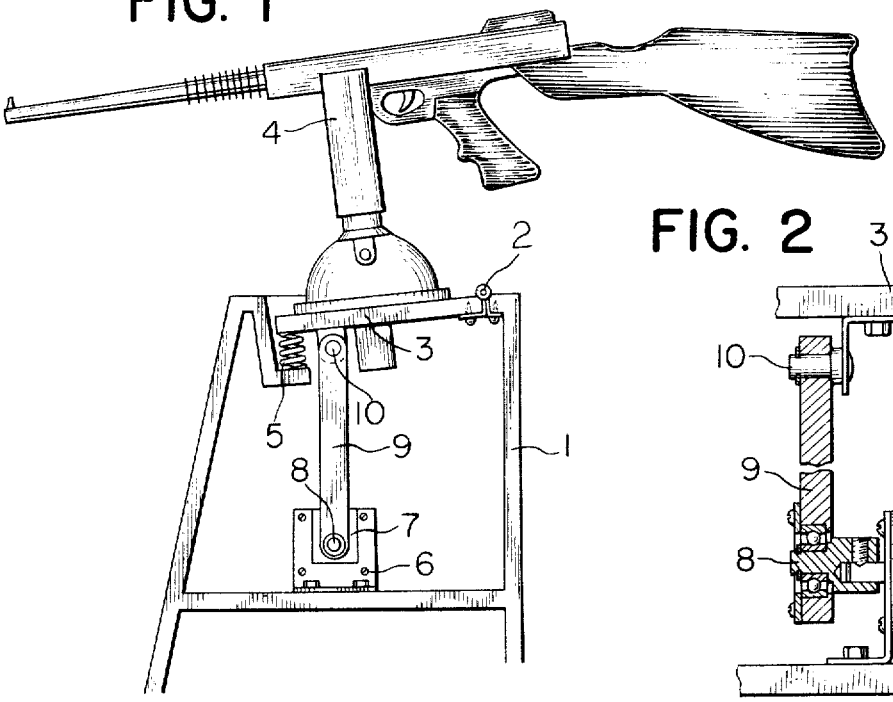
Figure 2:
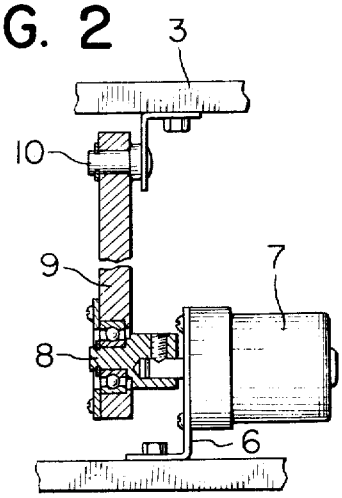
Figure 4:
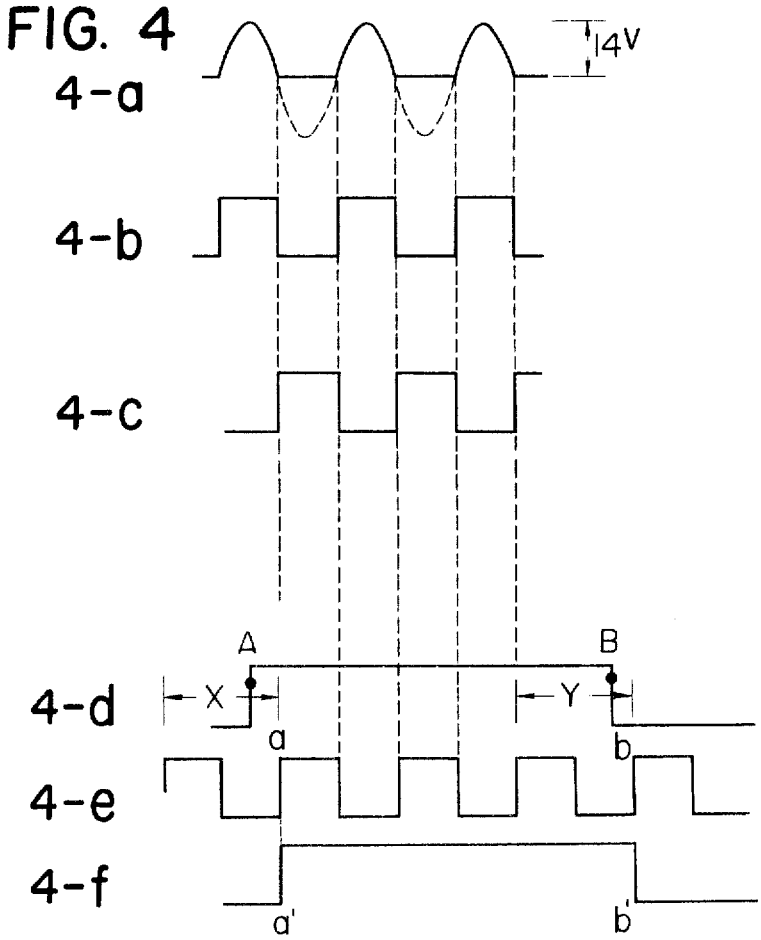
Figure 3:
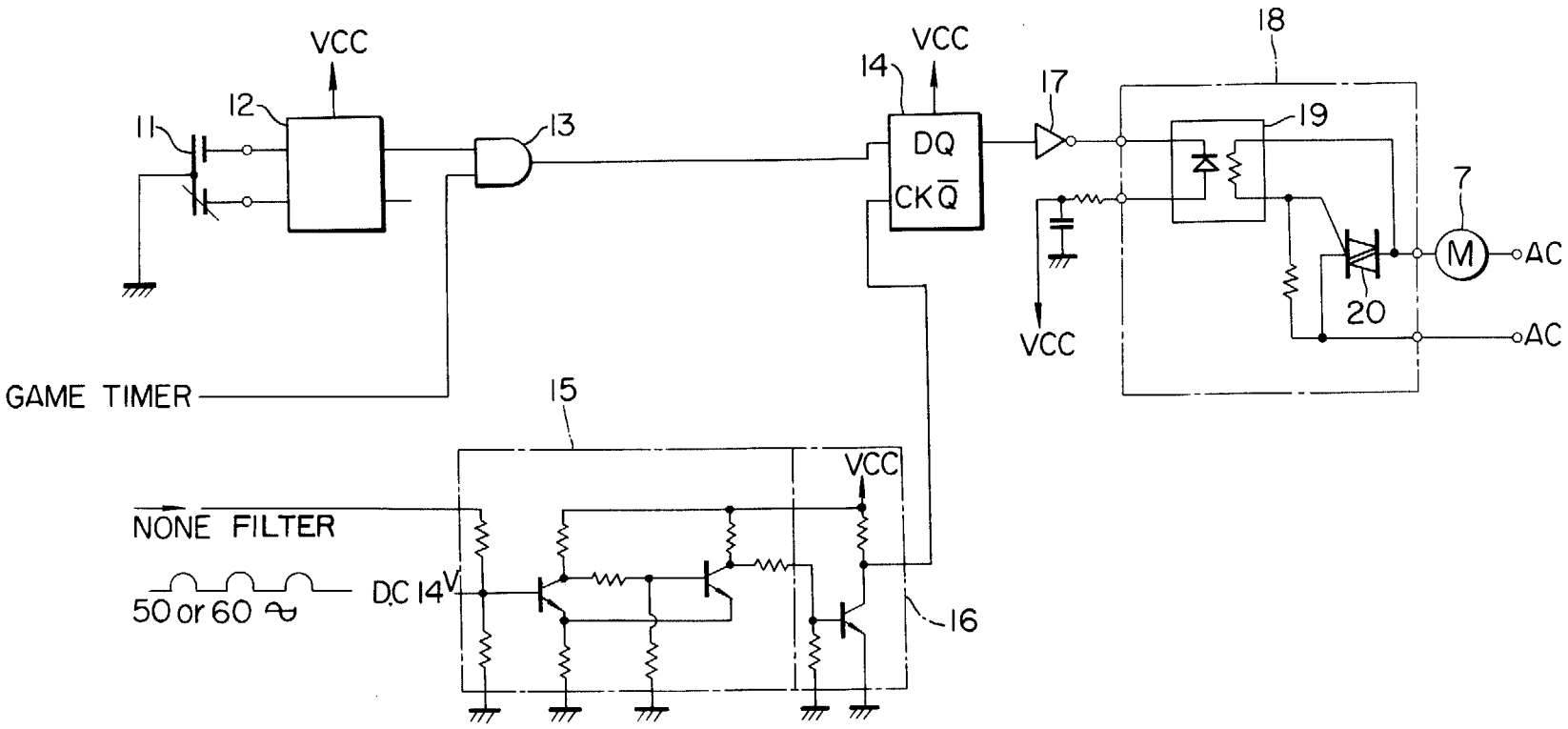

These and other features and advantages of the present invention will become more apparent by reference to the following description taken in conjunction with the accompanying drawings, in which:

FIG. 1 is a side view illustrating one preferred embodiment of the apparatus for simulating recoil in an imitation gun according to the present invention, FIG. 2 is a longitudinal cross-section front view of an essential part of the apparatus in FIG. 1, FIG. 3 is a control circuit diagram for the said apparatus, and FIG. 4 is a time chart showing operation modes of said apparatus.

Now the invention will be described in more detail with respect to the illustrated embodiment. Referring to FIGS. 1 and 2 of the drawings, reference numeral 1 designates a frame, and a gun mounting base 3 is pivotably mounted by means of a hinge 2 at the top rear portion of said frame 1 so as to be freely movable up and down around said hinge 2, and on said gun mounting base 3 is mounted an imitation gun 4.

Between said frame 1 and the front end of the gun mounting base 3 is interposed a spring 5 for acting against the weight of the gun mounting base 3 and the imitation gun 4, and owing to the elastic restoring force of said spring 5 said gun mounting base 3 is prevented from sinking very far.

In addition, under said gun mounting base 3, a motor 7 is mounted on said frame 1 by means of a bracket 6, on the rotary shaft of said motor 7 is fixedly mounted an eccentric crank 8. A shaft 10 projecting from said gun mounting base 3 and the eccentric crank 8 are mutually coupled by a connecting rod 9, so that upon rotation of said motor 7, said gun mounting base 3 is adapted to be raised and lowered about the hinge 2.

With reference to FIG. 3, reference numeral 11 designates a trigger switch coupled to a trigger of the imitation gun 4, and if the trigger is pulled, said trigger switch 11 is adapted to be kept closed during the period when the trigger is being pulled.

Said trigger switch 11 is connected to a flip-flop circuit 12, the output terminal of said flip-flop circuit 12 being connected to one input of an AND gate 13, and to the other input terminal of said AND gate 13 is connected a game timer (not shown), so that when said flip-flop circuit 12 is set and an output is emitted therefrom, if the game timer is actuated for a given period of time in response to insertion of a coin, then an output is emitted from the AND gate 13.

The output terminal of said AND gate 13 is connected to an input terminal of a D-type flip-flop circuit 14, and to a clock terminal of said D-type flip-flop circuit 14 are fed clock pulses having a rectangular waveform synchronized with an A.C. line source.

The clock pulses fed to said D-type flip-flop circuit 14 are formed by the steps of cutting out the negative portion of an A.C. line source voltage as shown in FIG. 4-*a*, shaping the half-wave input into a rectangular waveform as shown in FIG. 4-*b* by means of a Schmidt trigger circuit 15, and inverting this waveform as shown in FIG. 4-*c* by means of an inverter 16.

In the D-type flip-flop 14, assuming that the input signal at the D-input terminal which follows the ON-OFF operation of the trigger switch 11 is turned ON at point A and turned OFF at point B as shown in FIG. 4-*d*, then an output signal as shown in FIG. 4-*f* is emitted from the Q-output terminal of the D-type flip-flop circuit, which output signal is delimited by time points *a'* and *b'* synchronized with the rise points *a* and *b*, respectively, of the clock input as shown in FIG. 4-*e*, during the respective periods of the clock input designated by arrows X and Y.

The output from the Q-output terminal of the D-type flip-flop 14 is transmitted to a photo-coupler 19 in a motor control unit 18 via an inverter 17, and the output of the photo-coupler 19 is applied to a triac 20.

Since the illustrated embodiment is constructed as described above, when the trigger of the imitation gun 4 is pulled, the trigger switch 11 is closed in response thereto, and if it is assumed that the game timer is then being operated for a given period of time in response to insertion of a coin, then an input signal is transmitted from the AND gate 13 to the D-input terminal of the D-type flip-flop circuit 14 at a time of, for example, point A in FIG. 4-*d*.

However, since a signal is transmitted from the D-type flip-flop circuit 14 via the inverter 17 to the motor control unit 18 at a time point *a* owing to the Schmidt trigger circuit 15, the time point when the power supply circuit for the motor 7 is switched ON is coincident with the time point when the current through the motor 7 becomes zero, and at this time point the motor 7 is started.

When the motor 7 is started, the eccentric crank 8 is rotated, and due to the eccentric rotation the imitation gun 4 is reciprocated up and down, so that a feeling similar to that when a real automatic rifle has been successively fired, can be given to a player.

If the trigger of the imitation gun 4 is released, for example, at the time point B in FIG. 4-*d*, then the power source for the motor 7 is switched OFF at the time point *b'* in FIG. 4-*f*, and thus the motor 7 is stopped.

As described, according to the illustrated embodiment, the player is given a feeling similar to that upon firing a real gun.

In addition, since the electric circuit for the motor 7 is adapted to be opened and closed in the proximity of a null point of the current through the motor 7 owing to the above-described control circuit, noises that may arise in the electric control circuit of a playing machine, not shown, associated with the imitation gun 4 can be prevented.

Still further, since the output from the Q-terminal of the D-type flip-flop circuit 14 is not directly applied to the motor control unit 18, but instead the output from the Q-terminal of the D-type flip-flop is inverted by the inverter 17 and then applied to the motor control unit 18, the output of the D-type flip-flop circuit 14 is subjected to a buffer action, and thereby erroneous operation thereof can be prevented.

Since many changes could be made in the above construction and many apparently widely different embodiments of this invention could be made without departing the scope thereof, it is intended that all matter contained in the above description or shown in the accompanying drawings shall be interpreted as illustrative and not in a limiting sense.

What is claimed is:

1. An apparatus for simulating recoil in an imitation gun, comprising a frame, an imitation gun mounted on said frame in a freely movable manner including up and down movement, an electric motor having a rotary shaft, an eccentric fixed on said shaft, coupling means coupled between said shaft and imitation gun through said eccentric for reciprocating said imitation gun up and down for each rotation of the shaft of said motor and a control circuit coupled between the trigger of said gun for rotating said motor when said trigger is actuated and continuing rotation of said motor while said trigger is maintained in the actuated position.

* * * * *